US007422645B2

(12) United States Patent
Lukasak et al.

(10) Patent No.: US 7,422,645 B2
(45) Date of Patent: Sep. 9, 2008

(54) METHOD OF PRESS QUENCHING ALUMINUM ALLOY 6020

(75) Inventors: David A. Lukasak, Lafayette, IN (US); Thomas J. Klemp, Massena, NY (US)

(73) Assignee: Alcoa, Inc., Pittsburgh, PA (US)

( * ) Notice: Subject to any disclaimer, the term of this patent is extended or adjusted under 35 U.S.C. 154(b) by 0 days.

(21) Appl. No.: 11/219,186

(22) Filed: Sep. 2, 2005

(65) Prior Publication Data

US 2007/0051443 A1 Mar. 8, 2007

(51) Int. Cl.
*C22F 1/05* (2006.01)

(52) U.S. Cl. ..... 148/690; 148/550

(58) Field of Classification Search ..... 148/550, 148/690, 689
See application file for complete search history.

(56) References Cited

U.S. PATENT DOCUMENTS

| | | | | | |
|---|---|---|---|---|---|
| 3,990,922 | A | * | 11/1976 | Gullotti et al. | 148/690 |
| 4,589,932 | A | | 5/1986 | Park | 148/12.7 |
| 4,861,389 | A | | 8/1989 | Bryant et al. | 148/3 |
| 4,909,858 | A | * | 3/1990 | Reiso | 148/550 |
| 5,522,950 | A | | 6/1996 | Bartges et al. | 148/550 |
| 5,820,708 | A | | 10/1998 | Jarrett | 148/689 |
| 6,364,969 | B1 | | 4/2002 | Couper | 148/415 |
| 6,440,359 | B1 | | 8/2002 | Parson et al. | 420/544 |
| 6,565,679 | B1 | | 5/2003 | Jeffrey et al. | 148/417 |

FOREIGN PATENT DOCUMENTS

GB 917 385 2/1963

OTHER PUBLICATIONS

"ASM Handbooks Online", 'Extrusion Speeds and Temperatures', www://products.asminternational.org/hbk/index.jsp, 2002.*
"Extrusion of Aluminum Alloys", pp. 186-198, 396-397, 406-407, Kluwer Academic Publishers, 1999, author T. Sheppard.
"UltrAlloy 6020—Understanding Cold Finished Aluminum Alloys", Internet Article, Oct. 31, 2004, pp. 1-2, www.alcoa.com.
"UltrAlloy 6020: A Lead-Free Aluminum Alloy Featuring "A" Rated Machinability", pp. 61-68, 1998 Society of Automotive Engineers, Inc., Alcoa Engineered Products, author Coleen M. Spillard.

* cited by examiner

*Primary Examiner*—Roy King
*Assistant Examiner*—Janelle Morillo
(74) *Attorney, Agent, or Firm*—Ehab M. Samuel; Greenberg Traurig LLP

(57) ABSTRACT

A method of press quenching a 6020 aluminum alloy comprising the steps of providing an ingot or billet of 6020 aluminum alloy consisting essentially of about 0.5 to about 0.6% silicon, about 0.7 to about 0.8% magnesium, about 0.55 to about 0.65% copper, about 0.35 to about 0.45% iron, about 0.01 to about 0.04% manganese, about 1.05 to about 1.15% tin, and about 0.04 to about 0.06% chromium; homogenizing the billet, cooling the billet, reheating the billet, extruding the billet, quenching the extrusion, and artificially aging the extrusion. The alloy has enhanced productivity, strength, and machinability and can be used as a direct replacement for lead containing alloy 6262 T-6.

15 Claims, 4 Drawing Sheets

METHOD OF PRESS QUENCHING ALUMINUM ALLOY 6020

FIELD OF THE INVENTION

The invention relates to a method of press quenching a 6XXX series aluminum alloy, preferably aluminum alloy 6020. This press-quenched aluminum alloy can be used as a direct replacement for lead containing alloy 6262-T6, thereby addressing any environmental issues that may be raised.

BACKGROUND OF THE INVENTION

Aluminum alloy 6020 was developed in 1992 for cold finished product possessing good machinability. Cold finished products include wire, rod, and bar applications that have been used in the automotive and commercial industries. Machinability can be defined as the relative ease with which the material can be machined. Machining processes include such processes as roughing, finishing, and milling. Good machinability is difficult to measure, however one ranking system that has been used for some time classifies machinability based on a letter scale with an "A" rating being most machinable, followed by "B", "C", "D" and "E" ratings taking into account the following characteristics:

(1) Chip Size. Smaller chip sizes are more desired because such chips simplify the machining operation and facilitate more effective heat removal from the tool work piece interface than larger chips. Chips must not be too small or they interfere with lubricant recirculation during the overall machining operation, such as by drilling or cutting. Long, thin chips by contrast tend to curl around themselves rather than break. Such chips, sometimes called curlings, may require manual removal from the machining area and are less effective than smaller chips at heat dissipation because larger chips tend to block the cooling lubricant.

(2) Tool Wear. Lower tool wear rates are desired to save money by increasing the amount of time a tool can be used before prescribed tolerances for a given work piece are exceeded. Lower tool wear rates further increase productivity by reducing downtime due to tool changeovers.

(3) Surface Finish. Alloys exhibiting a very smooth exterior surface finish in the as-machined condition are more desired to eliminate or reduce the need for subsequent surface finishing operations, such as grinding and deburring.

(4) Machining Forces. Lower machining forces are more desired to: reduce power requirements and the amount of frictional heat generated in the work piece, tool and tool head; or increase the amount of machining or metal removal that can be accomplished with the same power requirements; and (5) Mechanical and Corrosion Properties. Mechanical characteristics such as strength, or other properties such as corrosion resistance, may be "optional" with respect to machinability. They can also be rather important depending on the intended end use for the work piece being machined.

Although this "A" through "E" rating system is based on the five parameters discussed above, the relative importance of each parameter changes as a function of intended end use for any given alloy.

The desire to get lead out of the alloy for environmental reasons drove the development of aluminum alloy 6020. It was desired to extend this alloy to a press quenched product to also address environmental issues related to press quench aluminum alloy 6262-T6. A press quenched product is one that has been rapidly cooled from an elevated deformation extrusion temperature by immersion in a liquid bath, such as oil or water, so as to withdraw heat rapidly from the product. Air can also be used as a substitute for liquid. The purpose of quenching is to suppress a phase transformation so as to obtain increased hardness, or other desirable properties. The severity of the quench depends upon the capacity of the liquid or air to withdraw heat rapidly from the metal, this in turn depending upon other factors, such as the latent heat of vaporization, thermal conductivity, specific heat, and viscosity of the liquid or air.

Attempts to extend 6020 to a press quenched product were met with several problems. One problem was that magnesium (Mg) combined with tin (Sn) during billet reheat, which resulted in low strength, such as tensile strength, and poor machinability. Tensile strength is the resistance of a product to a force tending to tear it apart, measured as the maximum tension the product can withstand without tearing. When an aluminum alloy product, such as a billet or ingot, is extruded, it is first reheated to and held at a temperature in the alloy above the solubility temperature in the precipitated phases in the aluminum matrix, for instance the solubility temperature for the magnesium (Mg)-silicon (Si) phases in a billet made of an Al—Mg—Si-alloy, until the phases are dissolved. The product is then quickly cooled or quenched to the desired extrusion temperature to prevent new precipitation of these phases in the alloy structure. Between the temperatures of 800° F. and 920° F., magnesium combines with tin at a rapid rate to form magnesium tin. Above 920° F., the magnesium and tin do not combine and will actually dissociate from each other. Below 800° F., the reaction is sluggish and there is typically not enough time during billet reheat for these two elements to substantially combine. The product forms for which a press quenched 6020 alloy is desired are rod, bar, and wire applications. For press quench products of this nature, billet temperatures of 825 to 900° F. are typically utilized. As described above, this temperature range will not allow alloy 6020 to achieve acceptable machinability in the press quenched product.

In addition, other problems encountered were that there was a low producability compared to 6262 when overcoming this magnesium-tin combination issue and there was a lack of an optimized composition within the sales limits. In extrusion, the higher the billet temperature, the slower the extrusion speed that can be attained. As described, previously the preferred billet temperature range for alloys such as 6262 is 800 to 920° F. As aforementioned, these temperatures resulted in unacceptable machinability for the 6020 alloy. Going to higher billet temperatures resulted in a significant loss of extrusion productivity. Additionally, the composition was not optimized for press quenched products. It was discovered that higher magnesium levels resulted in a greater degradation to machinability. The higher Mg levels provide a higher driving force to promote the formation of Mg2Sn below approximately 920° F. To counter this effect, the magnesium level is optimized towards the lower side of the sales limits. Additionally, the tin level was maximized to maintain a higher volume fraction of the desirable Sn phase that provides the favorable machining characteristics of 6020. However, with lower magnesium levels, the strength in the final product is compromised. To offset this Si levels are optimized towards the higher side of sales limits.

The primary object of the present invention is to provide a substantially lead free alloy that is press quenchable.

Another object of the present invention is to provide a press quench alloy with enhanced extrusion productivity and good mechanical properties and machinability.

A further object of the invention is to provide a press quench alloy that can be used as a direct replacement for lead containing alloy 6262-T6.

SUMMARY OF THE INVENTION

The present invention relates to a method of making a press-quenched 6020 aluminum alloy product. The method comprises the steps of: (a) providing an ingot or billet of a 6020 aluminum alloy consisting essentially of about 0.5 to about 0.6% silicon, about 0.7 to about 0.8% magnesium, about 0.55 to about 0.65% copper, about 0.35 to about 0.45% iron, about 0.01 to about 0.04% manganese, about 1.05 to about 1.15% tin, about 0.04 to about 0.06% chromium, not more than 0.034% lead, the balance being essentially aluminum and incidental elements and impurities; (b) homogenizing the billet to a temperature of preferably 1025° F. to 1050° F. for a four hour period; (c) cooling the homogenized billet at a cooling rate of about 400° F. for about an hour; (d) reheating the billet to a temperature preferably from about 775° F. to about 800° F. for preferably less than about five minutes; (e) extruding the billet at a speed in the range of preferably about 150 fpm to about 175 fpm and to an exit temperature of preferably 1000 to 1015° F.; (f) quenching the extrusion to an exit temperature of about 200° F. to about 350° F.; (g) stretching the extrusion at least about 1%; and (h) artificially aging the extrusion to a temperature in the range of 340° F. to 355° F. for a time period of about 8 hours.

Following the above method produces a press quenched 6020 aluminum alloy that is preferably suited for rod, bar, and wire applications. The alloy has enhanced productivity, strength, and machinability and can be used as a direct replacement for lead containing alloy 6262 T-6.

DETAILED DESCRIPTION OF PREFERRED EMBODIMENTS

Figure 1:
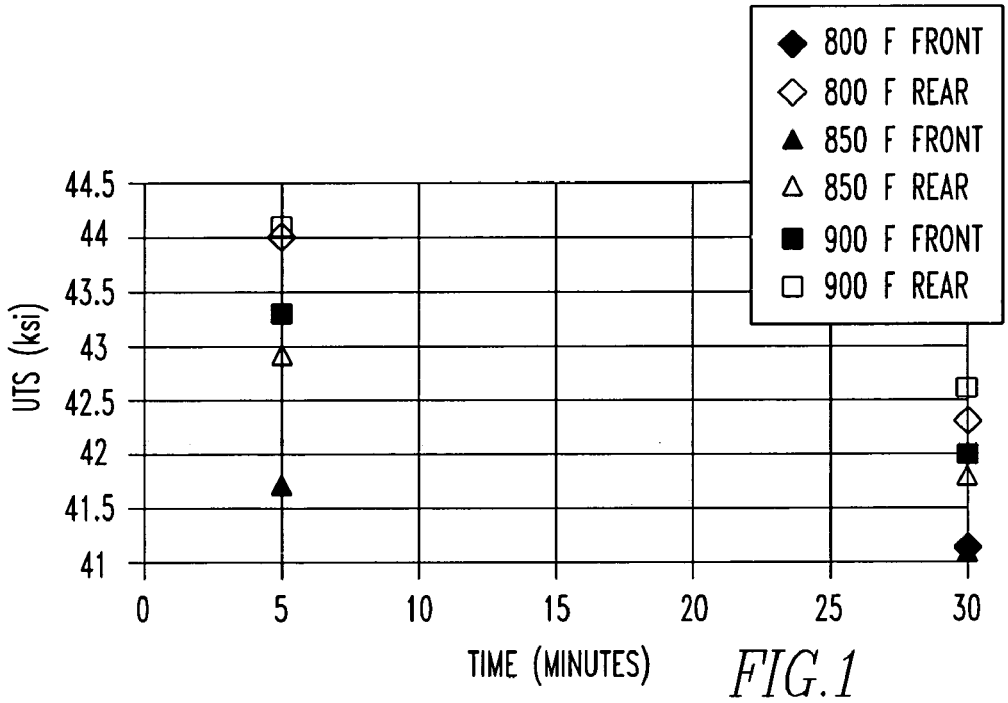
FIG. 1 shows the influence of billet reheat time and temperature on ultimate tensile strength.

The press quench 6020 alloy of the present invention contains silicon, magnesium, copper, iron, manganese, chromium, and tin. The silicon content ranges preferably from about 0.5% to about 0.6%, all percentages herein being by weight. Magnesium is preferably present in amounts of about 0.7% to about 0.8%. It is believed that maintaining the magnesium in this range yields a billet with improved machinability. In addition to the respective percentages for silicon and magnesium, it is preferred in practicing the invention that silicon be present in excess over that amount theoretically consumed as $Mg_2Si$. However, it is also important that the extent of the excess be relatively slight. This is largely affected by controlling the amount of magnesium to exceed the amount of silicon by about 0.1% to about 0.3%, although at the highest magnesium (Mg)-lowest silicon (Si) corner of the composition window a slight excess of magnesium is tolerated. The significance of this relationship is providing for high yield and tensile strengths. Limiting the silicon excess to a small excess provides for combining such strength with improved toughness and impact resistance. Copper is present preferably from about 0.55% to about 0.65%. Iron is present in a preferable range of about 0.35% to about 0.45%. The amount of manganese ranges from about 0.01% to about 0.04%, with the preferable amount being about 0.02%. Tin is present at a range of about 1.05% to about 1.15% with the preferable amount being about 1.10%. Chromium is present at a preferable range of about 0.04% to about 0.06%. Running near zero levels for chromium and manganese is believed to be the most desirable for getting a fine grain size.

In practicing the invention, it is important that the billets be subjected to a very high preheat or homogenizing temperature of about 1020° F. to about 1070° F., preferably about 1025° F. to about 1050° F. for about a four hour period. The billet is preheated by any method used to heat the billet, but for the purposes of this invention an electric furnace was used. At this range of temperature, the potential for coarsening of the tin (Sn) phase is minimized. Coarsening is the growth of the Sn phase to an undesirable size that results in a distribution (particles per unit volume) that can negatively influence machinability. Minimizing the coarsening of the tin phase results in the extrusions having higher tensile properties, such as tensile strength (TS), tensile yield strength (TYS) and ultimate tensile strength (UTS), and a more desirable machining performance. For the purposes of this invention, tensile strength, as previously mentioned, can be defined as the maximum amount of stress that a material can be subjected to before it will tears. In addition, tensile yield strength can be defined as the point where deformation of the material is unrecovered, and the work produced by external forces, such as stress, is not stored as elastic energy but will lead to contraction, cracks, and ultimately failure of the construction, and ultimate tensile strength is the limit stress at which the material actually tears.

Figure 2:
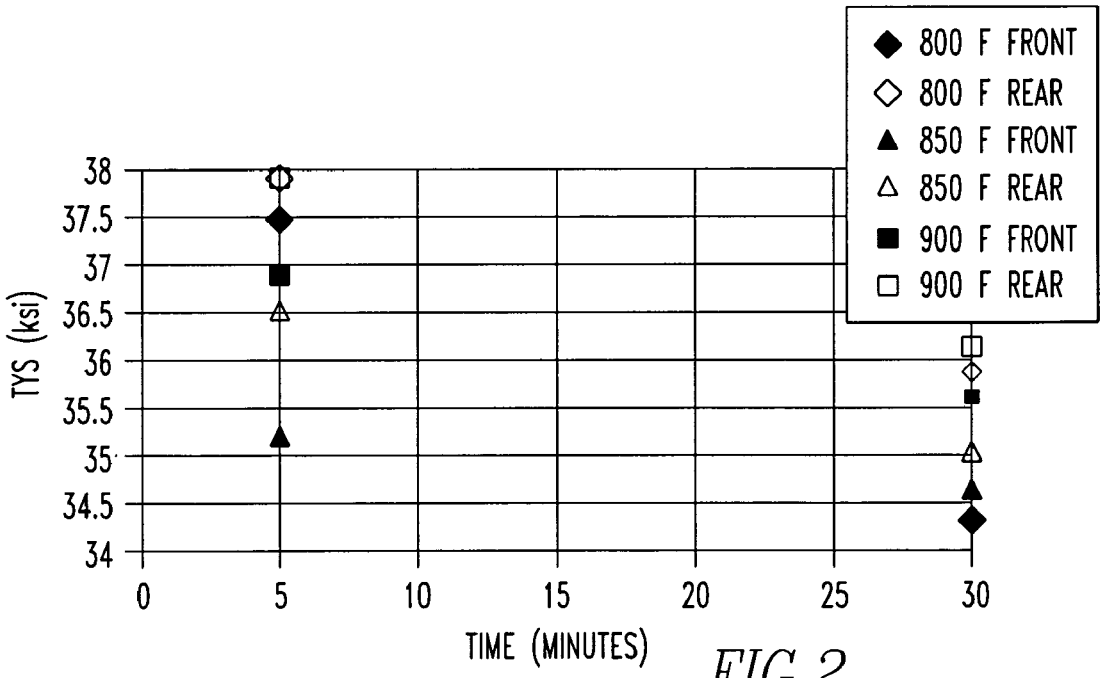
FIG. 2 shows the influence of billet reheat time and temperature on tensile yield strength.

The billet is then cooled at a cooling rate of about 400° F. for about an hour. Cooling is achieved by placing the homogenized load of ingots in a specially designed cooling chamber that forces air or other cooling media through the billet to achieve the cooling rate. This cooling rate minimizes the formation of magnesium tin (Mg2Sn), which can negatively impact machinability. Thereafter, the billet is reheated to a temperature in the range of from about 600° F. to about 900° F., preferably from about 775° F. to about 800° F. The billet is reheated for less than about thirty minutes, preferably for less than about five minutes. Any method could be used to reheat the billet, but for the purposes of this invention the billet was reheated via the use of both gas and electric furnaces. FIGS. 1-4 show that reheating the billet at this preferred temperature and for this amount of time yields the highest strength and best machinability. FIGS. 1 and 2 show the influence of billet temperature and time on ultimate tensile strength and tensile yield strength. From these figures, it is apparent that longer hold times result in a lowering of strength. Additionally, 850° F. results in lower strength than either 800° F. or 900° F. reheat temperatures. For purposes that will be described later, reheating the billet to a temperature of 800° F. or below increases the chances of obtaining the preferable billet exit temperature of 950 to 975° F. from extrusion. The ultimate tensile strength is preferably at least about 41 kilopounds per square inch (ksi) and the tensile yield strength is preferably at least about 35 ksi.

Figure 3:
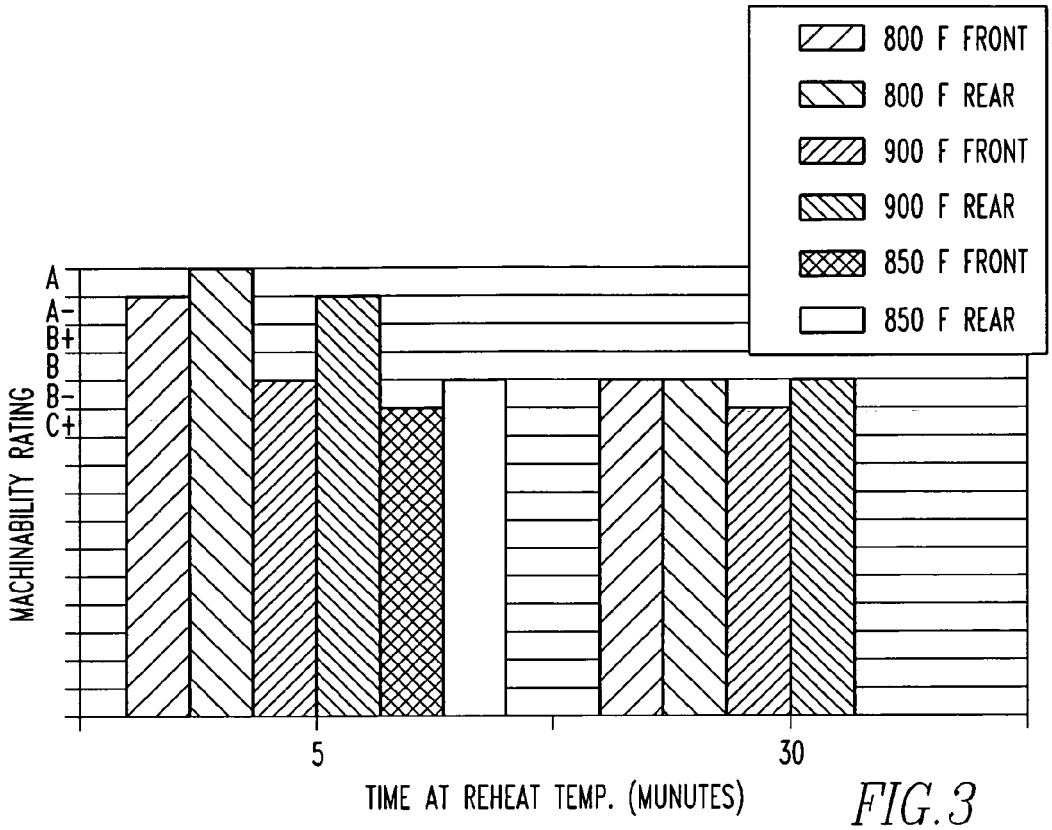
FIG. 3 shows the effect of billet reheat temperature and time on machinability.
Figure 4:
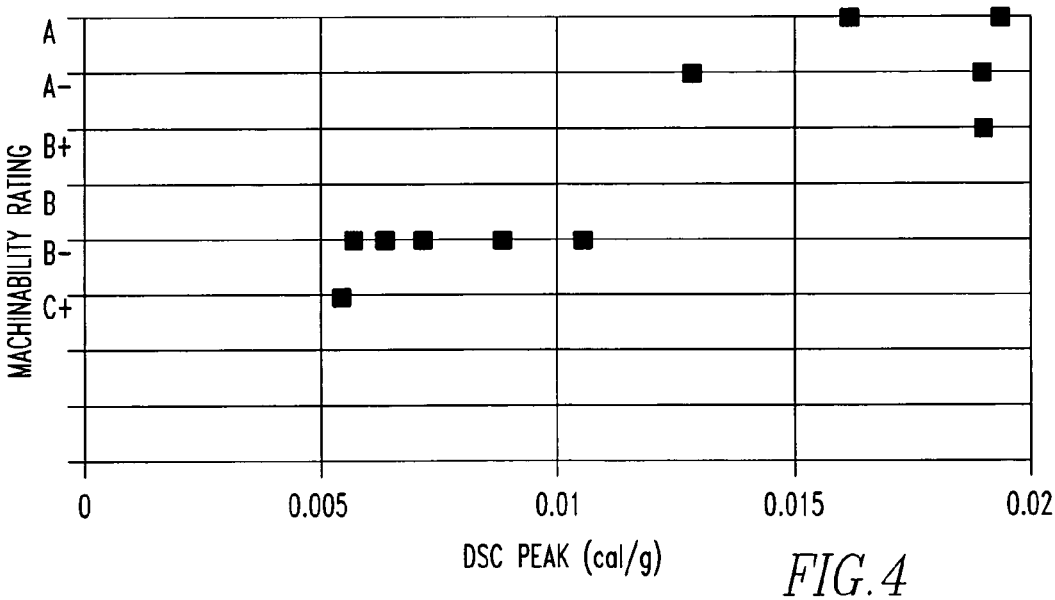
FIG. 4 shows the DSC peak area for the Sn phase versus machinability.

In addition to the tensile properties, machinability was evaluated for the extrusions. FIG. 3 shows the effect of billet reheat temperature and time on machinability. From this graph, it is observed that the longer hold times and the 850° F. reheat temperature are detrimental to machinability. Overall, the 800° F. billet reheat for hold times less than about 5 minutes yielded the best machinability. In order to understand what was being affected in the microstructure by the various billet reheat conditions, differential scanning calorimetry (DSC) was performed. DSC is a precise measure of energy consumption or release per unit mass during the heating or cooling of a material. Phase transformations, such as the aforementioned Sn to $Mg_2Sn$, can be detected with this technique and the amount of energy change is a function of the volume fraction of the phase present. FIG. 4 shows DSC peak area for the Tin (Sn) phase versus machinabilty results. Here it can be observed that the larger peak area, which occurs when the billet is reheated at about 800° F. for less than about 5 minutes, results in improved machinability. However, the difference in peak area between a C+rating and an A rating is small, again suggesting that the microstructural difference is subtle.

Prior to extruding, the billet is placed in a container with the container having a temperature of about 750° F. For the purposes of this invention, an extrusion press container was used. The billet is then extruded via direct or indirect extrusion. Direct extrusion is a process in which a die is held stationary and a moving arm or ram forces the billet through it. Indirect extrusion is a process in which the billet remains stationary while the die moves against the billet creating pressure needed for metal to flow through the die. For purposes of this invention, direct extrusion is preferred. The die can be any type of die used to extrude an alloy. For the purposes of this invention, a single hole flat faced die was used. A higher extrusion ratio is realized with the single hole die because it has a better opportunity to "break-up" and redistribute the coarsened tin phase from the billet. Extrusion ratio is the ratio of billet cross section area to the extrusion cross section. Using a flat-faced or shallow pocket die prevents significant heat-up and avoids compromising speed. Flat face dies and shallow pocket dies do not have a weld pocket that allows for the welding together of two extrusions as metal flows through the die opening. This results in less work and less heat build-up as the metal flows through the die opening. The extrusions are run at speeds which achieve exit temperatures of 950° F. to 1015° F., preferably 1000 to 1015° F. Based on the tin (Sn) to magnesium tin ($Mg_2Sn$) transformation starting at around 930° F., it is preferable that the exit temperature be above 950° F. However, temperatures around 1000° F. are even more desirable from the standpoint of reverting any of the transformation of Sn to $Mg_2Sn$ that has taken place either during the cooling from ingot homogenization or during the billet reheat.

Figure 5:
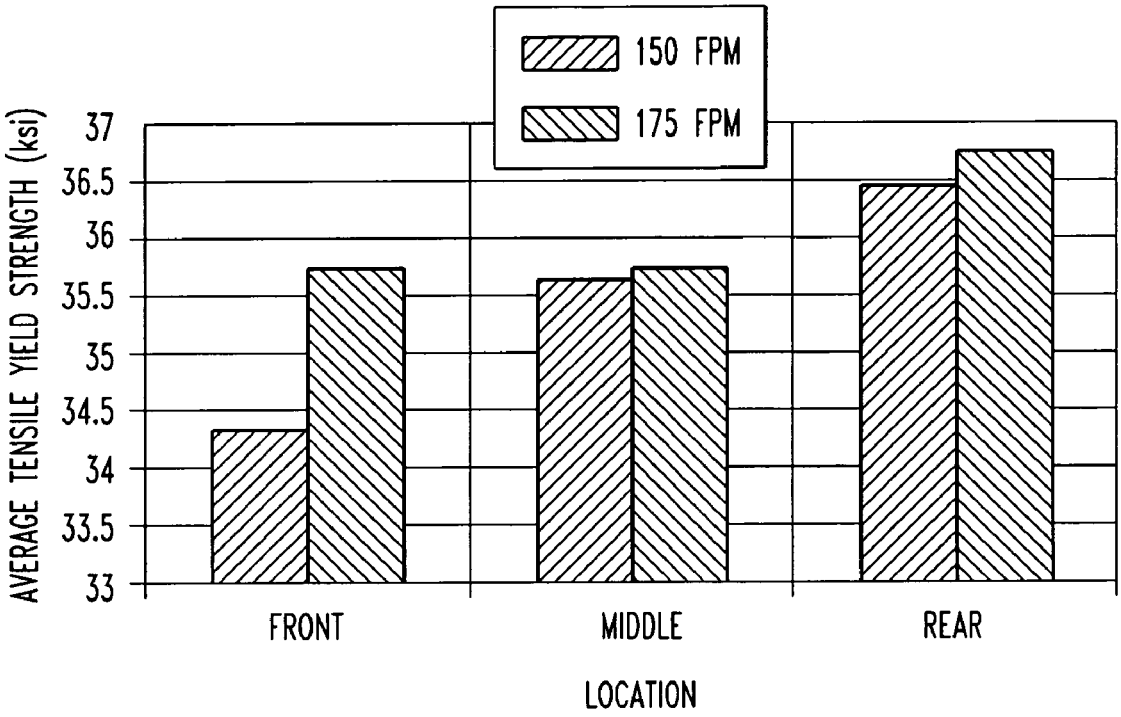
FIG. 5 shows the average yield strength as a function of extrusion speed and location.
Figure 6:
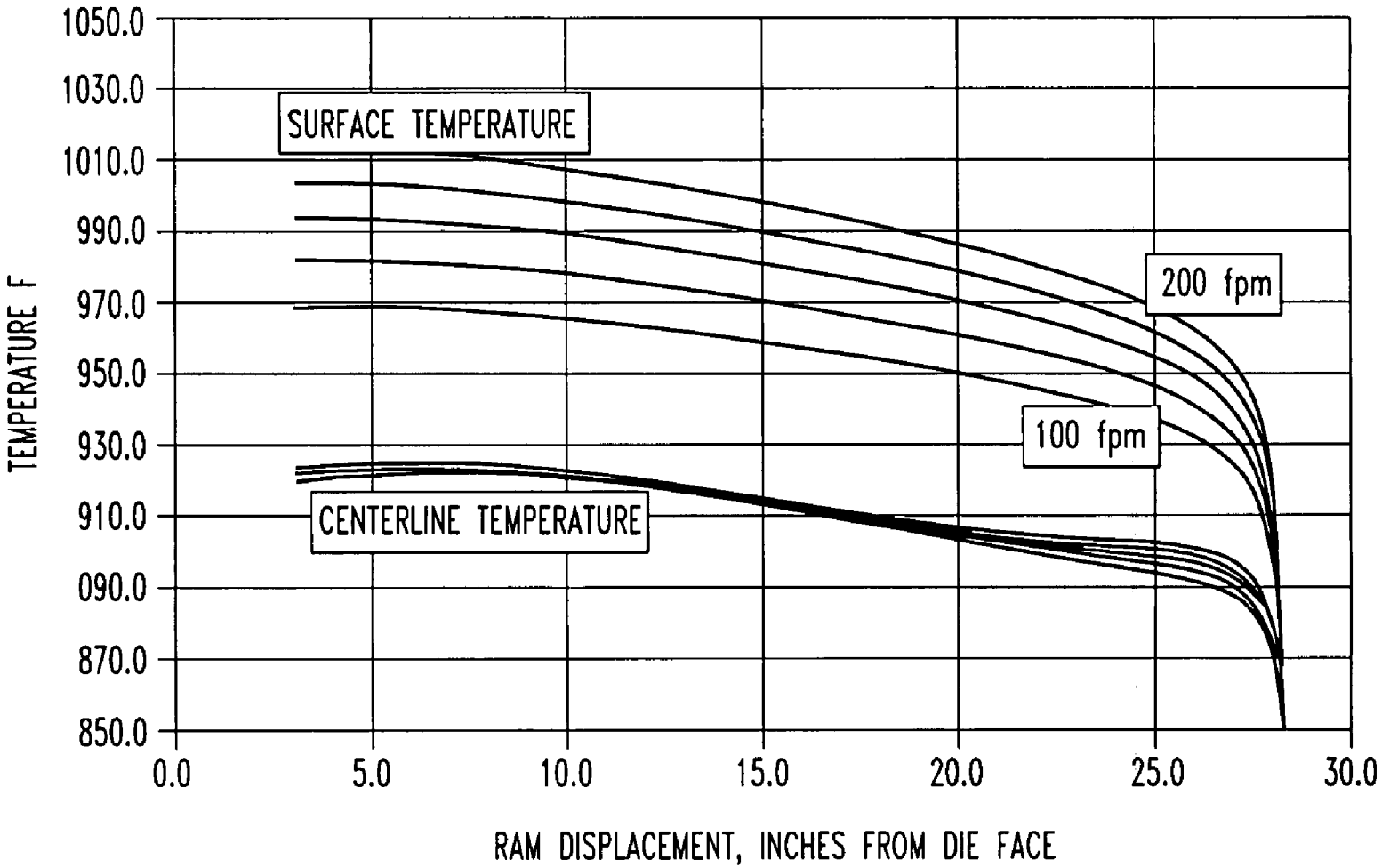
FIG. 6 shows a set of curves for exit temperature as a function of billet location and extrusion speed.

The speeds are measured in feet per minute (fpm) and range from about 150 fpm to about 175 fpm with a preferable speed of about 175 fpm. FIG. 5 plots the yield strength as a function of extrusion speed and location. This demonstrates that the properties increase from front to rear. Since exit temperature increases from front to rear for a given extrusion speed and set of temperature conditions, the low front-end properties are a result of low extrusion exit temperatures. The graph in FIG. 6 shows a predictive set of curves for exit temperature as a function of billet location and extrusion speed. Product speed varied from 100 fpm to 200 fpm by 25 fpm increments. Based on this plot, speeds of about 150 fpm to about 175 fpm would generate marginal properties on the front end of the extrusion due to the front end exit temperatures being above the preferable 950° F. temperature. For reasons previously discussed, exit temperatures above 950° F. and preferably around 1000° F. are desired to achieve maximum properties.

Once the billet has been extruded, the extrusion is then quenched. For the purposes of this invention, the extrusion was quenched by use of a standing wave water quench. A standing wave is a wall of water several feet in length and a height sufficient to completely immerse the extrusion. Pumps and piping are used to create the wave and to provide a continuous replenishment of cool water. However, any method of quenching the extrusion, such as air quenching, could be used. The speed at which the extrusion is quenched can be at speeds of up to about 200 fpm, but a speed of around about 150 fpm is preferred. Upon exiting quench, the extrusion is preferably at a temperature of below about 400° F. It is necessary to get below about 400° F. in order to achieve the required strength levels. After the extrusion is quenched, it is then stretched by at least about 1%. For the purposes of this invention, an extrusion stretcher was used. However, other means could be used to stretch the extrusion. Stretching the extrusion by this percentage increases the producability of the extrusion. Finally, the extrusion is artificially aged, preferably from between about 340° F. to about 355° F. for about 8 hours. Artificially aging is typically performed in, but not restricted to, a batch age oven. The extrusions are heated in the batch oven to the temperatures listed above. This process is the final processing step that is required to achieve the required strength. This process is dependent on all prior processing steps being performed correctly.

Following the method outlined above will produce a fine-grained, fully recrystallized, press quenched product that demonstrates good strength and elongation. It is clearly capable of meeting the 6262-T6 property minimums with good press productivity.

Having described the presently preferred embodiments, it is to be understood that the invention may be otherwise embodied within the scope of the appended claims.

What is claimed is:

1. A method of extruding a press quenched 6020 aluminum alloy product comprising the steps of:

(a) providing an ingot or billet of a 6020 aluminum alloy;

(b) homogenizing said billet;

(c) cooling said homogenized billet;

(d) reheating said billet to a temperature in the range of about 750° F. to about 800° F. for less than about five minutes;

(e) extruding said billet at a speed in the range of about 150 fpm to about 175 fpm to provide an extrusion having a temperature greater than 930° F.;

(f) quenching said extrusion;

(g) stretching said extrusion; and (h) artificially aging said extrusion.

2. The method according to claim 1 wherein said alloy is of a composition consisting essentially of about 0.5 to about 0.6% silicon, about 0.7 to about 0.8% magnesium, about 0.55 to about 0.65% copper, about 0.35 to about 0.45% iron, about 0.01 to about 0.04% manganese, about 1.05 to about 1.15% tin, about 0.04 to about 0.06% chromium, not more than about 0,034% lead, the balance being essentially aluminum and incidental elements and impurities.

3. The method according to claim 1 wherein said temperature for the reheating step is in the range of from about 775° F. to about 800° F.

4. The method according to claim 1 wherein said billet is placed in a container prior to extruding, said container having a temperature of about 750° F.

5. The method according to claim 1 wherein said speed is about 175 fpm.

6. The method according to claim 1 wherein said extrusion is at a temperature range of about 950° F. to about 1000° F. after said extrusion.

7. The method according to claim 1 wherein said extruding step provides an extrusion having a temperature above about 1000° F.

8. The method according to claim 1 wherein said temperature of said extrusion is in a range comprising about 200° F. to about 350° F. after said quenching.

9. The method according to claim 1 wherein said quenching comprises air or water quench.

10. The method according to claim 1 wherein said extrusion is stretched about 1%.

11. The method according to claim 1 wherein said artificial aging occurs at a temperature in the range of about 340° F. to about 355° F. for a time period of about 8 hours.

12. The method of claim 1 wherein said extrusion comprises a bar, rod, or wire.

13. The method of claim 1 wherein said extrusion has an ultimate tensile strength of at least about 41 ksi.

14. The method of claim 1 wherein said extrusion has a tensile yield strength of at least about 35 ksi.

15. The method of claim 1 wherein said extrusion has an ultimate tensile strength of at least about 41 ksi and a tensile yield strength of at least about 35 ksi.

* * * * *